US011713623B2

(12) United States Patent
Keiser

(10) Patent No.: US 11,713,623 B2
(45) Date of Patent: Aug. 1, 2023

(54) MOTOR POWER SECTION WITH INTEGRATED SENSORS

(71) Applicant: Scientific Drilling International, Inc., Houston, TX (US)

(72) Inventor: William Daniel Keiser, Houston, TX (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 17/827,689

(22) Filed: May 28, 2022

(65) Prior Publication Data

US 2022/0298863 A1 Sep. 22, 2022

Related U.S. Application Data

(63) Continuation of application No. 15/605,429, filed on May 25, 2017, now abandoned.

(60) Provisional application No. 62/342,842, filed on May 27, 2016.

(51) Int. Cl.

| | |
|---|---|
| ***E21B 4/02*** | (2006.01) |
| ***E21B 47/024*** | (2006.01) |
| ***E21B 7/06*** | (2006.01) |
| ***E21B 47/01*** | (2012.01) |

(52) U.S. Cl.
CPC ..... *E21B 4/02* (2013.01); *E21B 7/067* (2013.01); *E21B 47/01* (2013.01); *E21B 47/024* (2013.01)

(58) Field of Classification Search
CPC ..... E21B 4/02; E21B 7/067; E21B 47/024
See application file for complete search history.

(56) References Cited

U.S. PATENT DOCUMENTS

| | | | | |
|---|---|---|---|---|
| 2005/0109542 | A1* | 5/2005 | Downton | E21B 17/1014 175/73 |
| 2016/0290050 | A1* | 10/2016 | Murray | E21B 17/1064 |
| 2017/0051600 | A1* | 2/2017 | Jarman | E21B 19/22 |
| 2017/0328144 | A1* | 11/2017 | Roberson | E21B 17/1085 |
| 2017/0342773 | A1* | 11/2017 | Keiser | E21B 7/067 |

OTHER PUBLICATIONS

Bent sub definition available from: https://petrowiki.spe.org/Glossary:Bent_sub (Year: 2022).*

* cited by examiner

*Primary Examiner* — Theodore N Yao
(74) *Attorney, Agent, or Firm* — Ewing & Jones, PLLC

(57) ABSTRACT

The disclosure includes a power section for a bottom hole assembly for use in a wellbore. The power section may include a stator, the stator including a housing, a stator insert, a payload housing and a bent sub having a bend direction. The payload housing may be positioned on an outer surface of the housing, and the payload housing may include a payload pocket. The power section may include a rotor, the rotor rotatable eccentrically within the stator. The payload housing may positioned on the stator housing so as to be always aligned with the bend direction.

22 Claims, 5 Drawing Sheets

MOTOR POWER SECTION WITH INTEGRATED SENSORS

CROSS REFERENCE TO RELATED APPLICATIONS

This application is a continuation application which claims priority from U.S. utility application Ser. No. 15/605,429, filed May 25, 2017, which is itself a nonprovisional application that claims priority from U.S. provisional application No. 62/342,842, filed May 27, 2016.

TECHNICAL FIELD/FIELD OF THE DISCLOSURE

The present disclosure relates generally to a motor power section, in particular a motor power section with integrated sensors.

Background of the Disclosure

Accurately determining the position and orientation of a drilling assembly during drilling operations may be desirable, particularly when drilling deviated wells. Traditionally, a combination of sensors is used to measure downhole trajectory and subterranean conditions. Data collected in this fashion is traditionally transmitted to the surface via MWD telemetry. Many factors may combine to unpredictably influence the trajectory of a drilled borehole. Accurate determination of the borehole trajectory may be used to determine the position of the borehole and to guide the borehole to its geological objective as well as avoiding collisions with underground objects, geological features, wells, or zones. In other cases, it is desired to intercept underground objects, geological features, wells, or zones.

In some instances, surveying of a borehole using conventional methods involves the periodic measurement of the Earth's magnetic and gravitational fields to determine the azimuth and inclination of the borehole at the bottom hole assembly. In some instances, the distance, orientation, or both the distance and orientation of a borehole relative to other boreholes is determined by periodically or continuously measuring the magnetic field that is produced either passively from the adjacent wellbore's casing or drillpipe or by measuring an actively generated magnetic field.

As the wellbore is drilled, the greater the distance between the drill bit and sensors, commonly known as a MWD package, the longer it takes for any changes in the azimuth, inclination, relative distance, or relative orientation of the wellbore at the drill bit to be recognized by an operator. In some bottom hole assemblies, some equipment used in the bottom hole assembly, such as a mud motor, may move traditional MWD packages a long distance from the drill bit, and thus delay feedback or impede accuracy on azimuth and inclination data of the wellbore. Typically, a mud motor may include a power section including a stator and rotor. The stator typically includes a thin housing and an elastomeric stator insert.

SUMMARY

The disclosure includes a power section for a bottom hole assembly for use in a wellbore. The power section includes a stator, the stator including a housing, and a stator insert. The power section further includes a rotor, the rotor rotatable eccentrically within the stator. In addition, the power section includes a sensor package, the sensor package integrated into the power section.

The disclosure includes a power section for a bottom hole assembly for use in a wellbore. The power section includes a stator, the stator including a housing, a stator insert, and a payload housing. The payload housing is positioned on an outer surface of the housing, and the payload housing includes a payload pocket. The power section further includes a rotor, the rotor rotatable eccentrically within the stator.

The disclosure also provides a bottom hole assembly for use in a wellbore. The bottom hole assembly includes a power section. The power section includes a stator, the stator having a housing, a stator insert, and a payload housing. The payload housing is positioned on an outer surface of the housing and the payload housing includes a payload pocket. The power section also includes a rotor, the rotor rotatable eccentrically within the stator. The bottom hole assembly also includes a flex shaft, the flex shaft mechanically coupled to the rotor and rotatable by the rotor. In addition, the bottom hole assembly includes an intermediate shaft, the intermediate shaft positioned within the housing and mechanically coupled to the flex shaft. The intermediate shaft is rotatable concentrically with the housing. The bottom hole assembly includes a bent sub, the bent sub mechanically coupled to the housing, and a bit shaft, the bit shaft mechanically coupled to the intermediate shaft. In addition, the bottom hole assembly includes a drill bit, the drill bit mechanically coupled to the bit shaft.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
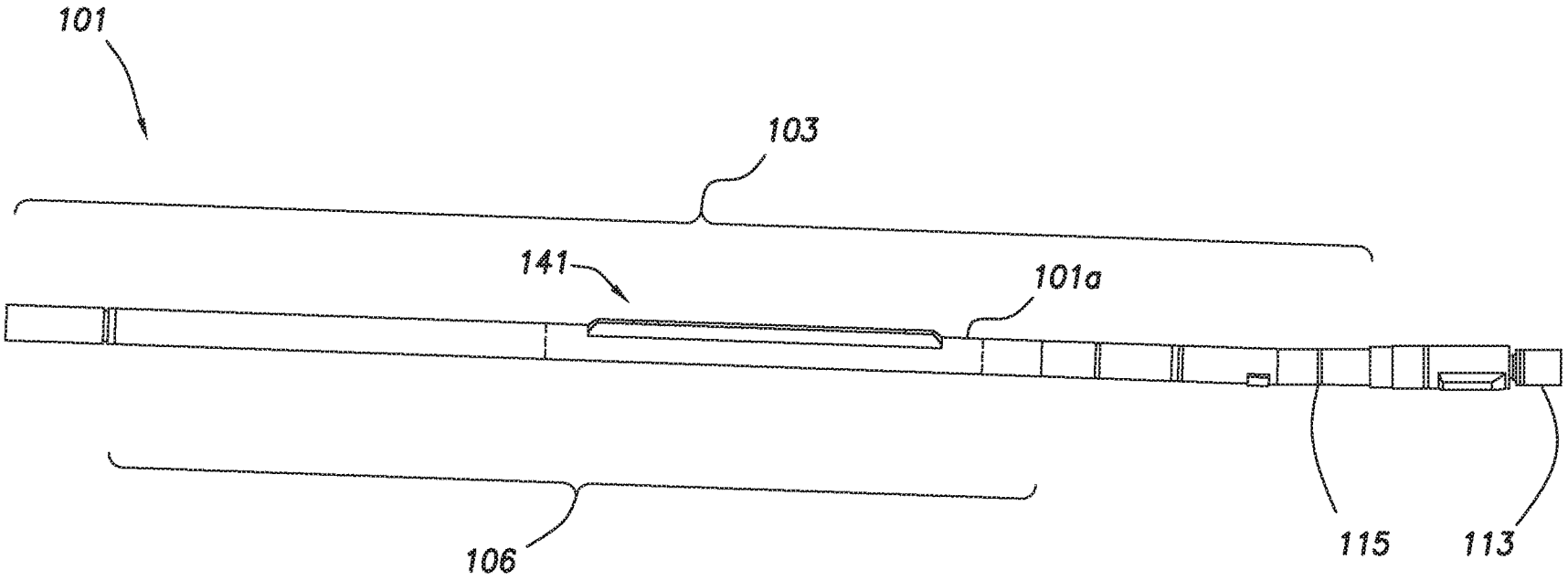
FIG. 1 depicts an elevation view of a bottom hole assembly having a motor power section with integrated sensor package consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

In some embodiments of the present disclosure as depicted in FIG. 1, bottom hole assembly (BHA) 101 may include mud motor 103, having power section 106. BHA 101 may include drill bit 113. In some embodiments, BHA 101 may include bent sub 115. Although depicted and described herein as utilizing bent sub 115, one having ordinary skill in the art with the benefit of this disclosure will understand that BHA 101 may not include bent sub 115. In some embodiments, one or more wear pads or knots (not shown) may be positioned on an exterior surface of BHA 101, such as on an outer surface of power section 106.

Figure 2:
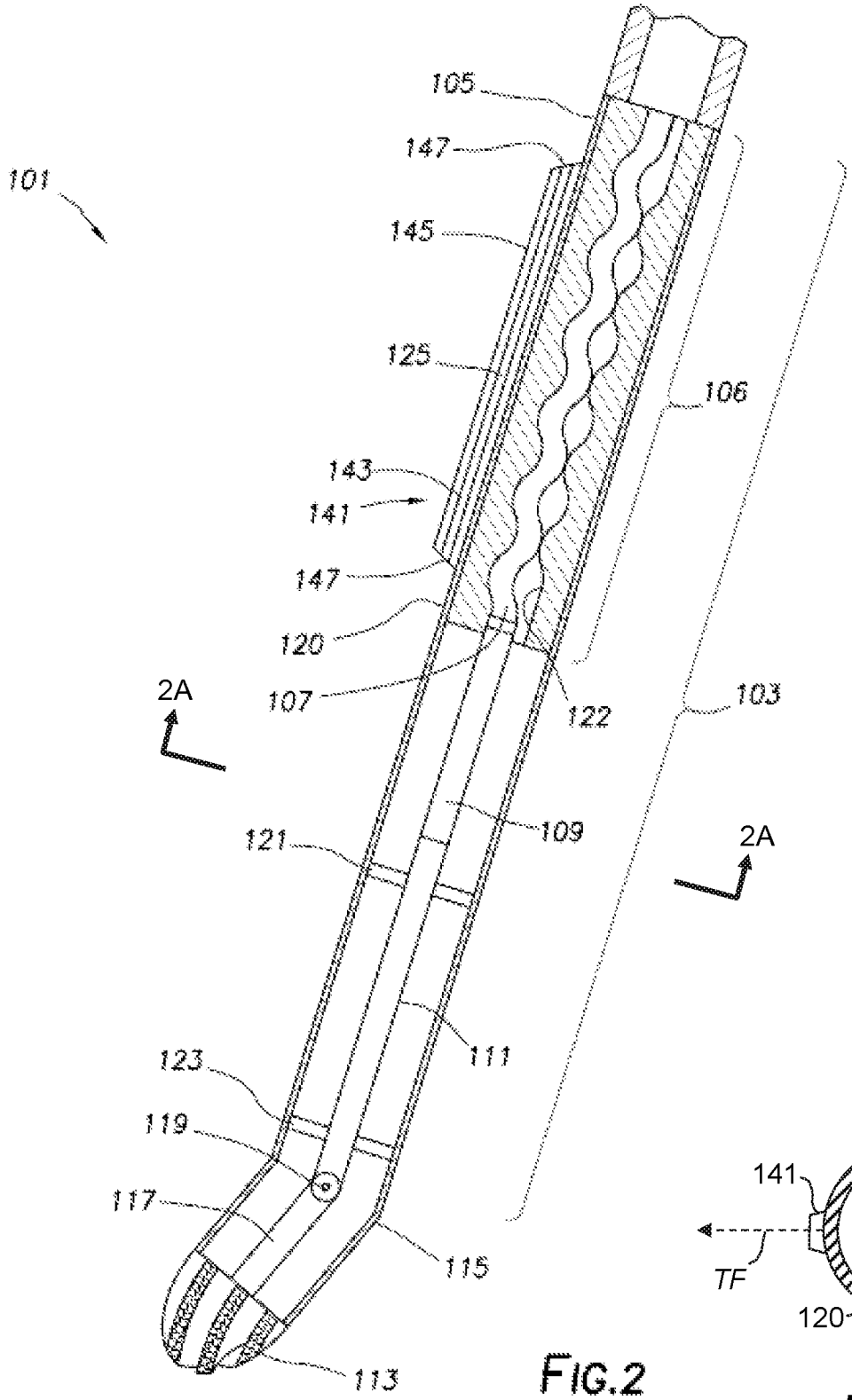
FIG. 2 depicts a cross section view of the bottom hole assembly of FIG. 1.

In some embodiments, as depicted in FIG. 2, power section 106 may include stator 105 and rotor 107. Stator 105 may include housing 120 and stator insert 122. Stator insert 122 may, in some embodiments, be formed from rubber and may be cast onto the inner surface of housing 120. Rotor 107 may rotate eccentrically within stator insert 122 of stator 105 as fluids are pumped through mud motor 103. In some embodiments, rotor 107 of power section 106 may be mechanically coupled by flex shaft 109 to intermediate shaft 111. Flex shaft 109 may serve to transmit rotational force between rotor 107 and intermediate shaft 111 and allow the eccentric movement of rotor 107 within stator 105 to be translated into the concentric rotation of intermediate shaft 111. Intermediate shaft 111 may, in some embodiments, transmit rotational force between mud motor 103 and drill bit 113. As understood in the art, one or more additional assemblies may be included in BHA 101 including, for example and without limitation, bent sub 115. In some embodiments, drill bit 113 may be mechanically coupled to bit shaft 117 which may be mechanically coupled to intermediate shaft 111 by, for example and without limitation, CV joint or knuckle joint 119.

In some embodiments, intermediate shaft 111 may be positioned within housing 120. In some embodiments, intermediate shaft 111 may be supported within housing 120 by one or more bearings, depicted in FIG. 2 as upper bearing 121 and lower bearing 123. Housing 120 may couple between mud motor 103 and any additional components of BHA 101 such as, for instance and without limitation, bent sub 115. Although discussed with a particular configuration of BHA 101, one having ordinary skill in the art with the benefit of this disclosure will understand that the specific configuration described and depicted herein is not intended to be limiting, and any suitable configuration of BHA 101 may be utilized without deviating from the scope of this disclosure. For example and without limitation, in some embodiments, although not depicted, one or more stabilized bearing housings or slick bearing housings may be included within BHA 101.

Figure 2A:
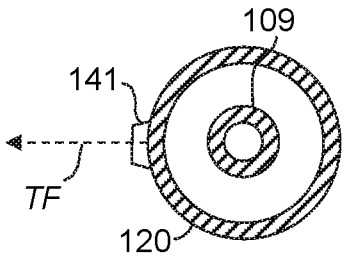
FIG. 2A depicts a view in section along lines 2A-2A of the bottom hole assembly of FIG. 2.

In certain embodiments of the present disclosure, sensors, including, but not limited to MWD or logging while drilling (LWD) sensors may be integrated into power section 106. In some embodiments, stator 105 may include payload pocket 143 into which sensors, such as MWD or LWD sensors may be positioned. In some embodiments, payload pocket 143 may be positioned within housing 120. In some embodiments, payload pocket 143 may be formed entirely within housing 120. In some embodiments, payload pocket 143 may be a cavity or recess formed in housing 120. In some embodiments, payload pocket 143 may be rotationally aligned with a toolface TF of BHA 101 as shown in FIG. 2A. As used herein, toolface refers to a rotational reference point along BHA 101. For example and without limitation, toolface may, in some embodiments, refer to the direction in which bent sub 115 is offset. In some embodiments, payload pocket 143 may be rotationally aligned opposite the toolface TF of BHA 101. In some embodiments, the rotational orientation of payload pocket 143 may be adjusted by, for example and without limitation, the inclusion of one or more shims in one or more threaded connections or by cutting the threads of the threaded connections to result in the desired alignment.

In some embodiments, one or more additional components of power section 106 may at least partially form payload pocket 143. For example, in some embodiments, sleeve 101*a* may be threadedly coupled within housing 120 and payload pocket 143 may be at least partially positioned within the sleeve. In some embodiments, payload pocket 143 may be a recess formed in the outer surface of housing 120. In some such embodiments, a hatch cover may be hingedly or removably coupled to housing 120 and positioned to close the recess while allowing selective access thereto. In some embodiments, BHA 101 may include more than one payload pocket 143. In some embodiments, one or more wireways may be formed in housing 120. The wireways may be formed such that wires may extend between payload pockets 143 or between payload pockets 143 and other components of BHA 101. In certain embodiments, wireways may be formed in payload housing 141.

Figure 3:
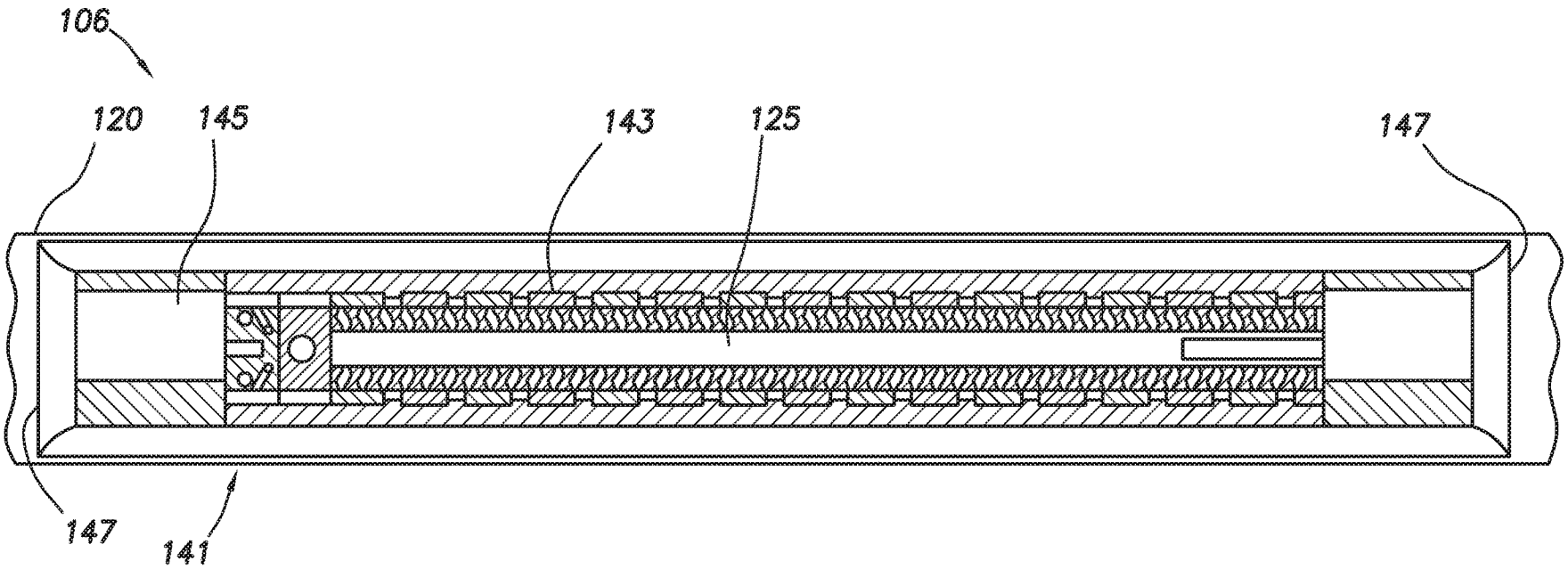
FIG. 3 depicts a partial cutaway view of the bottom hole assembly of FIG. 1.
Figure 4:
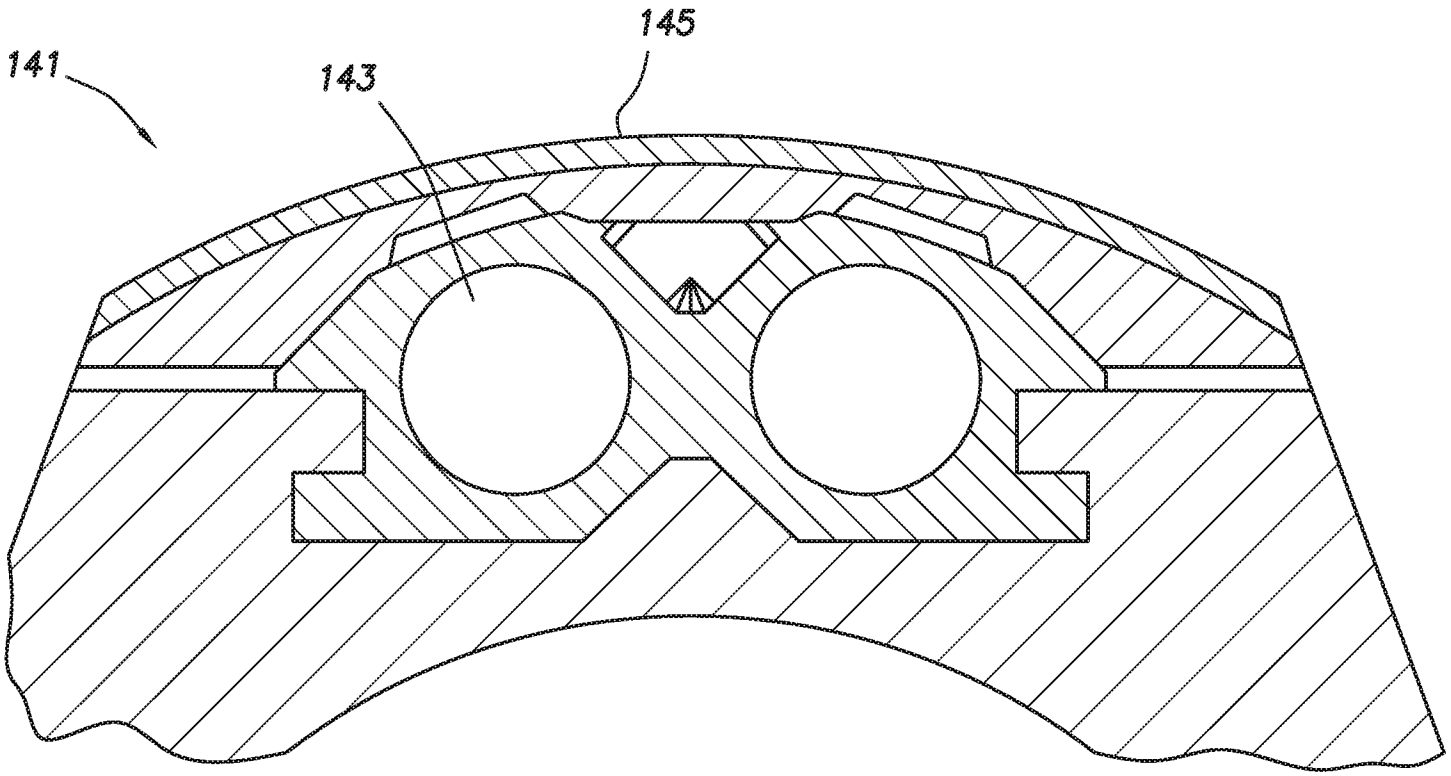
FIG. 4 depicts a partial cross section view of the bottom hole assembly of FIG. 1.

In some embodiments, BHA 101 may include payload housing 141. Payload housing 141 may be positioned on an outer surface of power section 106 as discussed further herein below. In some embodiments, payload pocket 143 may be positioned at least partially within payload housing 141. In some embodiments, payload housing may be positioned on an exterior surface of stator 105. In some embodiments, payload housing 141 may be mechanically coupled to stator 105. In some embodiments, payload pocket 143 may be an open area within which one or more downhole sensors may be positioned. For example, in some embodiments, sensor package 125 may be positioned within payload pocket 143. Sensor package 125 may include any downhole sensors, downhole measurement, or downhole telemetry equipment including one or more of an MWD or LWD system. As depicted in FIGS. 3 and 4, payload pocket 143 may include one or more openings into which sensor package 125 may be positioned.

In some embodiments, as depicted in FIG. 4, payload housing 141 may include wear pad 145. Wear pad 145 may be positioned on an exterior surface of payload housing 141. Wear pad 145 may, for example and without limitation, protect payload pocket 143 from the downhole environment, including abrasive materials and formations encountered during drilling operations. In some embodiments, as depicted in FIG. 3, payload housing 141 may include end plate 147. In some embodiments, end plate 147 may be removable from payload housing 141 to, for example and without limitation, allow access to payload pocket 143.

Figure 5:
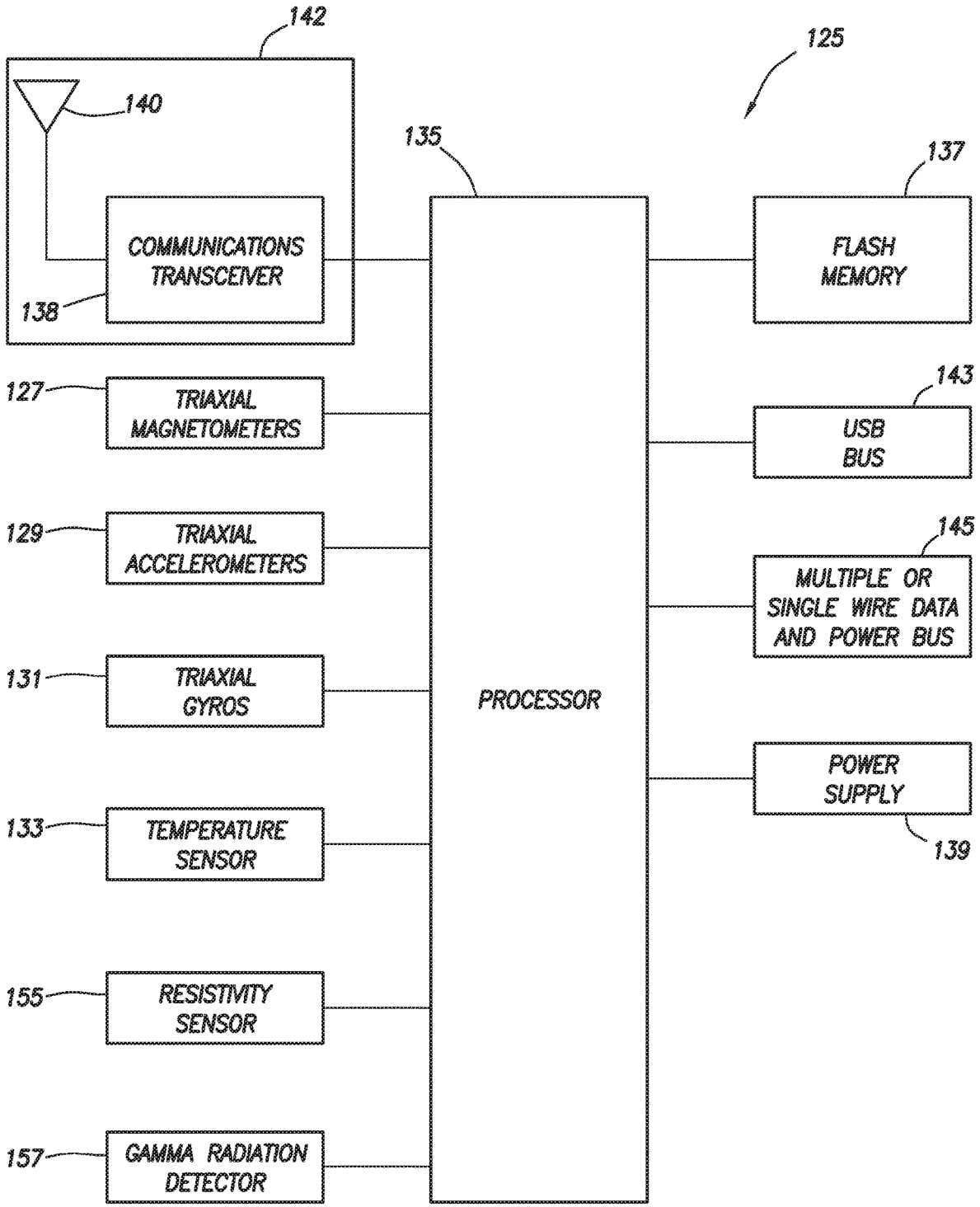
FIG. 5 depicts a schematic view of a MWD package consistent with at least one embodiment of the present disclosure.

In some embodiments, as depicted schematically in FIG. 5, sensor package 125 may include one or more sensors which may be positioned within payload pocket 143. The sensors may include, for example and without limitation, one or more magnetometers 127, accelerometers 129, gyros 131, temperature sensors 133, formation resistivity sensors 155, and gamma radiation detectors 157. As understood in the art, magnetometers 127, accelerometers 129, and gyros 131 may include multiple sensors to measure parameters in more than one axis, including, without limitation, in three orthogonal directions, commonly known as a triaxial arrangement.

In some embodiments, sensor package 125 may further include processor 135 and associated memory 137 to gather, receive, store, process, and/or transmit signals from the sensors. In some embodiments, processor 135 may receive and process commands. In some embodiments, sensor package 125 may be able to gather, receive, store, process, and/or transmit, for example and without limitation, one or more of total magnetic field strength, inclination, RPM, magnetometer data, accelerometer data, temperature, formation resistivity, gamma count, voltage and current data, date/time, and toolface.

In some embodiments, sensor package 125 may include power source 139 to power one or more of the sensors and processor 135. In some embodiments, power source 139 may include, for example and without limitation, one or more batteries or generators. Power source 139 may be integral to sensor package 125 or connected to sensor package 125 via a wire. In some embodiments, power source 139 may be positioned within payload pocket 143. In some embodiments, power source 139 may be electrically coupled to but located apart from payload pocket 143.

In some embodiments, sensor package 125 may include telemetry equipment 142 electronically coupled to processor 135 including, for example and without limitation, antenna 140, communications transceiver 138, or wired connection through a wireway as previously discussed for transmitting or receiving data.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A bottom hole assembly for use in a wellbore, the bottom hole assembly comprising:

a power section, the power section including:

a stator, the stator having a stator housing, a stator insert, and a payload housing, the payload housing fixedly positioned on an outer surface of the stator housing, the outer surface of the stator housing exposed to the wellbore and forming a continuous cylindrical outer surface, the stator insert positioned within the stator housing, the payload housing extending radially outward beyond the greatest radius of the stator housing, the payload housing including a payload pocket, whereby the payload housing extends radially outward beyond the outer surface of the stator housing, wherein the payload housing is at a same longitudinal position on a tool string as the stator insert;

a sensor package positioned at least partially within the payload housing; and a rotor, the rotor rotatable eccentrically within the stator;

a flex shaft, the flex shaft mechanically coupled to the rotor and rotatable by the rotor;

an intermediate shaft, the intermediate shaft positioned within the stator housing and mechanically coupled to the flex shaft, and the intermediate shaft rotatable concentrically with the stator housing;

a bent sub, the bent sub mechanically coupled to the stator housing and having a bend that defines a bend direction;

a bit shaft, the bit shaft mechanically coupled to the intermediate shaft; and a drill bit, the drill bit mechanically coupled to the bit shaft;

wherein the payload housing is positioned on the stator housing so as to be aligned with the bend direction.

2. The bottom hole assembly of claim 1 wherein the sensor package includes at least part of one or more of a MWD package, LWD package, downhole sensor package, downhole measurement package, or downhole telemetry package.

3. The bottom hole assembly of claim 1 wherein the sensor package comprises at least one of a magnetometer, accelerometer, gyro, temperature sensor, formation resistivity sensor or gamma radiation detector.

4. The bottom hole assembly of claim 1 wherein the payload housing further comprises a wear pad, the wear pad positioned on an exterior surface of the payload housing.

5. The bottom hole assembly of claim 1 wherein the stator housing further comprises one or more wireways formed therein, the wireways including wires positioned therein.

6. The bottom hole assembly of claim 1 wherein the sensor package comprises at least one sensor positioned within the payload pocket, and wherein the at least one sensor is part of one or more of a MWD package, LWD package, downhole sensor package, downhole measurement package, or downhole telemetry package positioned within the payload pocket.

7. The bottom hole assembly of claim 6 wherein the at least one sensor comprises at least one of a magnetometer, accelerometer, gyro, temperature sensor, formation resistivity sensor or gamma radiation detector.

8. The bottom hole assembly of claim 6, further comprising a processor positioned in the payload pocket, the processor electronically coupled to the at least one sensor to gather, receive, store, process, and/or transmit signals from the at least one sensor.

9. The bottom hole assembly of claim 8, further comprising an antenna, acoustic transceiver, or wired connection electronically coupled to the processor.

10. The bottom hole assembly of claim 1, further comprising a power source positioned within the payload pocket.

11. The bottom hole assembly of claim 10 wherein the power source is a battery or a generator.

12. A bottom hole assembly for use in a wellbore, the bottom hole assembly comprising:

a power section, the power section including:

a stator, the stator having a stator housing, a stator insert, and a payload housing, the payload housing fixedly positioned on an outer surface of the stator housing, the outer surface of the stator housing exposed to the wellbore and forming a continuous cylindrical outer surface, the stator insert positioned within the stator housing, the payload housing extending radially outward beyond the greatest radius of the stator housing, the payload housing including a payload pocket, whereby the payload housing extends radially outward beyond the outer surface of the stator housing, wherein the payload housing is at a same longitudinal position on a tool string as the stator insert;

a sensor package positioned at least partially within the payload housing; and a rotor, the rotor rotatable eccentrically within the stator;

a flex shaft, the flex shaft mechanically coupled to the rotor and rotatable by the rotor;

an intermediate shaft, the intermediate shaft positioned within the stator housing and mechanically coupled to the flex shaft, and the intermediate shaft rotatable concentrically with the stator housing;

a bent sub, the bent sub mechanically coupled to the stator housing and having a bend that defines a bend direction;

a bit shaft, the bit shaft mechanically coupled to the intermediate shaft; and a drill bit, the drill bit mechanically coupled to the bit shaft;

wherein the payload housing is positioned on the stator housing so as to be aligned opposite to the bend direction.

13. The bottom hole assembly of claim 12 wherein the sensor package includes at least part of one or more of a MWD package, LWD package, downhole sensor package, downhole measurement package, or downhole telemetry package.

14. The bottom hole assembly of claim 12 wherein the sensor package comprises at least one of a magnetometer, accelerometer, gyro, temperature sensor, formation resistivity sensor or gamma radiation detector.

15. The bottom hole assembly of claim 12 wherein the payload housing further comprises a wear pad, the wear pad positioned on an exterior surface of the payload housing.

16. The bottom hole assembly of claim 12 wherein the stator housing further comprises one or more wireways formed therein, the wireways including wires positioned therein.

17. The bottom hole assembly of claim 12 wherein the sensor package comprises at least one sensor positioned within the payload pocket, and wherein the at least one sensor is part of one or more of a MWD package, LWD package, downhole sensor package, downhole measurement package, or downhole telemetry package positioned within the payload pocket.

18. The bottom hole assembly of claim 17 wherein the at least one sensor comprises at least one of a magnetometer, accelerometer, gyro, temperature sensor, formation resistivity sensor or gamma radiation detector.

19. The bottom hole assembly of claim 17, further comprising a processor positioned in the payload pocket, the processor electronically coupled to the at least one sensor to gather, receive, store, process, and/or transmit signals from the at least one sensor.

20. The bottom hole assembly of claim 19, further comprising an antenna, acoustic transceiver, or wired connection electronically coupled to the processor.

21. The bottom hole assembly of claim 12, further comprising a power source positioned within the payload pocket.

22. The bottom hole assembly of claim 21 wherein the power source is a battery or a generator.

* * * * *